United States Patent [19]

Anson

[11] 4,023,921

[45] May 17, 1977

[54] OIL BURNER FOR $NO_x$ EMISSION CONTROL

[75] Inventor: Donald Anson, Los Altos, Calif.

[73] Assignee: Electric Power Research Institute, Palo Alto, Calif.

[22] Filed: Nov. 24, 1975

[21] Appl. No.: 634,702

[52] U.S. Cl. ..... 431/9; 431/115

[51] Int. Cl.[2] ..... F23L 7/00

[58] Field of Search ..... 431/8, 9, 10, 115, 116

[56] References Cited

UNITED STATES PATENTS

| | | | |
|---|---|---|---|
| 3,620,657 | 11/1971 | Robinson | 431/9 |
| 3,817,685 | 6/1974 | Joannes | 431/116 |
| 3,868,211 | 2/1975 | LaHaye et al. | 431/10 |
| 3,927,958 | 12/1975 | Quinn | 431/116 |

*Primary Examiner*—Edward G. Favors

*Attorney, Agent, or Firm*—Townsend and Townsend

[57] ABSTRACT

Method and apparatus for producing heat from a liquid fuel in an oil burner with a low $NO_x$-gas effluent. A small relatively higher velocity stream of air is directed concentric about a divergent spray or stream of ignited fuel oil in a primary flame zone in such amount that only a minor portion of the fuel can be combusted in said primary flame zone. The air is directed in such manner as to produce toroidal fluid circulation pattern atomizing the liquid fuel and establishing a stable flame. A small amount of recirculated flue gas (RFG) is immediately thereafter introduced concentrically about said primary flame zone in the general direction of fluid flow. Air is introduced concentrically thereabout in a secondary flame zone in the fluid flow path of said primary flame zone in at least sufficient quantity to burn the remaining combustibles. Oxides of nitrogen in the resultant effluent are suppressed by adjusting the amount of RFG and hence the flame composition and temperature.

10 Claims, 1 Drawing Figure

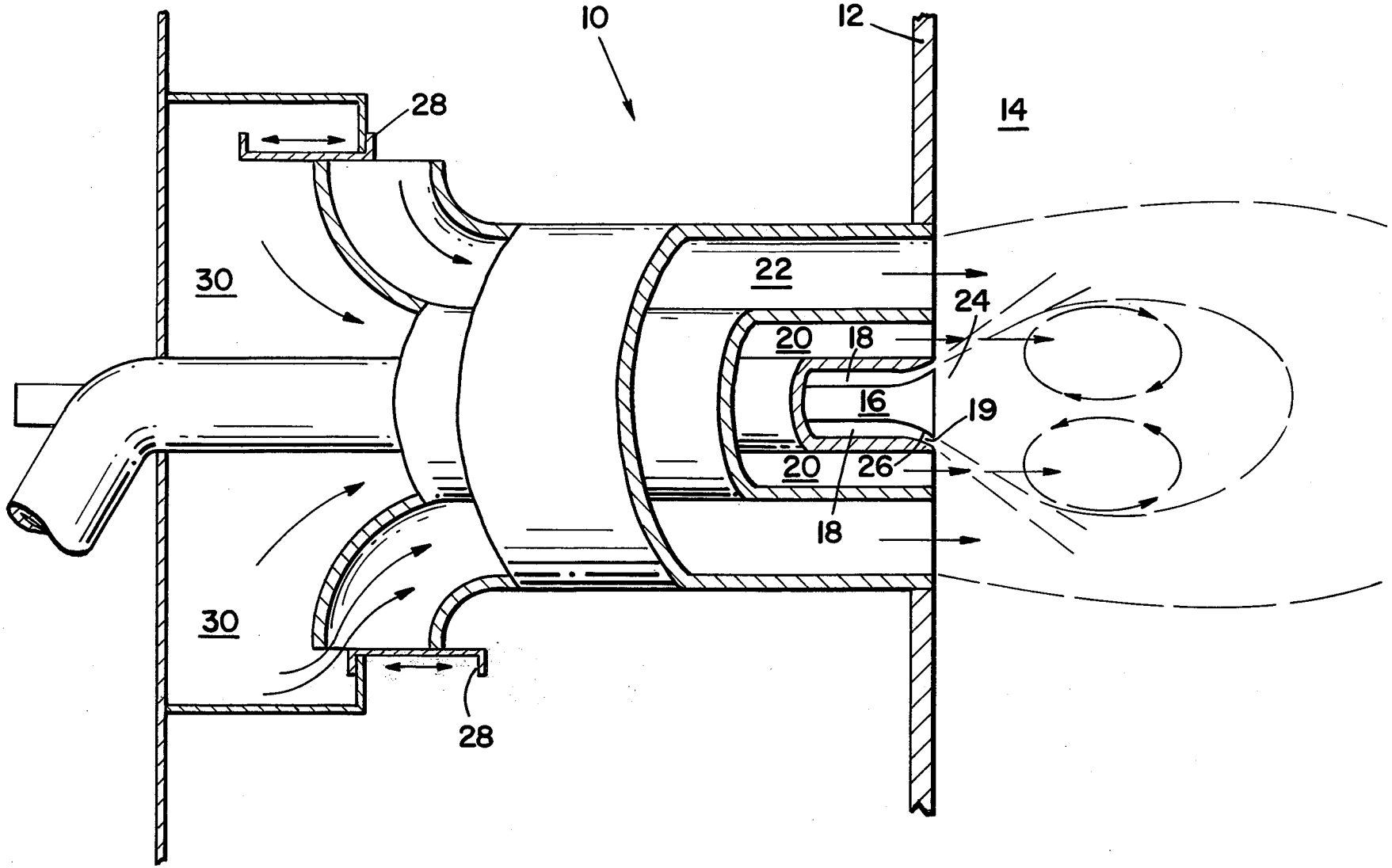
14
12
24
19
18
16
26
18
20
20
22
10
28
28
30
30

OIL BURNER FOR $NO_x$ EMISSION CONTROL

BACKGROUND OF THE INVENTION

1. Field of Invention

This invention relates to methods for burning liquid fuels in oil burners of furnaces and the like and particularly to a method for reducing the production of $NO_x$ gases while producing a stable flame during combustion in an oil burner.

2. Description of the Prior Art

An oil fuel burner comprises an oil sprayer or atomizer, an air supply and a stabilizer. The sprayer may be a pressure jet system utilizing pressure energy in the oil supply or it may utilize a second fluid (steam or air) to create a fine dispersion of the oil or to assist the pressure jet action. The air supply is essential for combustion. To ensure rapid mixing of the fuel and air, this air supply is normally in a highly turbulent condition. The stabilizer serves to provide, within the turbulent air supply, a quiescent or circulating flow zone in which a flame may be initiated and maintained. The stabilizer is usually a bluff body positioned within the air flow region and shaped to give the required quiescent zone.

A bluff body stabilizer in the combustion zone of a boiler is subject to damage by radiation and corrosion. This damage occurs particularly to a stabilizer of a burner which is out of service but which is in a hot furnace where other burners are operating. A further disadvantage of the bluff body type of stabilizer is that it necessarily obstructs the main air flow.

$NO_x$ gases have been identified as a major source of air pollution in the United States. Oil burners designed to inhibit the production of $NO_x$ gases are known wherein a jet of oil is introduced into a flame through a center passage and flue gas mixed with air is introduced through surrounding passages. U.S. Pat. No. 3,743,471 is an example of one such oil burner requiring a relatively substantial quantity of flue gas for this purpose. Methods and apparatus for controlling the production of $NO_x$ gases using flue gas in a fuel oil staged combustion process are disclosed in U.S. Pat. No. 3,868,211. U.S. Pat. No. 3,880,570 discloses a method of atomizing fuel oil and of utilizing recirculated flue gas to inhibit the production of $NO_x$ gases.

SUMMARY OF THE INVENTION

According to the invention, fuel oil is injected through a distributor arranged to provide a thin film or spray of oil along a divergent conical path, while a small relatively higher velocity stream of air is directed concentric about the tip of the oil distributor into a primary flame zone in such amount that only a minor portion of the fuel oil can be combusted in the primary flame zone. The air so directed intersects the oil spray to produce a toroidal fluid circulation pattern, atomizing the liquid fuel and establishing a stable flame. A small amount of recirculated flue gas (RFG) is introduced immediately thereafter concentrically about said primary flame zone in the general direction of fluid flow. The fluid effluent continues in a substantially straight path into a secondary flame zone. Relatively lower velocity air is introduced concentrically about the mixture in a secondary flame zone in at least sufficient quantity to burn the remaining combustibles. The limited oxygen supply in the primary zone and the admixture of RFG limit the flame temperature and substantially reduce the oxides of nitrogen in the effluent.

The particular objects and advantages of this invention will be apparent after examination of the following detailed description of specific embodiments.

BRIEF DESCRIPTION OF THE DRAWING

The single FIGURE illustrating the invention is a cut-away section of an oil burner nozzle adapted to operate according to a specific embodiment.

DETAILED DESCRIPTION OF THE SPECIFIC EMBODIMENTS

Referring to the FIGURE, an oil burner nozzle 10 is shown mounted in a furnace wall 12 to direct a flame along an axial burning path into the interior of a furnace 14. A furnace may have a plurality of oil burners so a portion may be turned off if less heat output is required.

An oil burner nozzle in operation defines a combustion path established by a fluid flow from the burner nozzle 10, which path comprises a relatively restricted primary flame zone adjacent the burner nozzle 10 in which the fuel oil is partially combusted, and a secondary flame zone which is a relatively long feather surrounding and extending beyond the primary flame zone. All fluid entering the primary flame zone must pass through the secondary flame zone along this combustion path.

The method of combustion according to the invention is as follows. A divergent conical spray of oil is injected into the primary flame zone while a relatively higher velocity annular stream of gas is directed into the primary flame zone intersecting the divergent conical spray. The gas stream so provided atomizes or assists in atomizing the oil to form a fluid mixture and provides enough oxygen to ignite the fluid mixture establishing a stable, but fuel-rich, flame in the primary flame zone.

More particularly, however, the high velocity air flow in the form of an annular jet around the axis of the distributor induces flow recirculation in front of the distributor in the region within the conical path along which the oil is injected; this recirculation provides a stabilizing region within which a flame may be initiated and maintained without any necessity for a bluff body intruding into the main air flow.

A small annular stream of relatively cool recirculated flue gas (RFG) is thereupon introduced radially outside the stabilizing region, that is, outside the primary flame zone. Turbulence draws the RFG into the mixture substantially increasing the molar quantity of the gaseous effluent from the primary flame zone without materially adding to the oxygen supply.

The main air flow is preferably fed into the secondary flame zone by injection parallel to the axis of the sprayer but radially outside the high velocity fluid flow in the primary flame zone. The mixture of gaseous effluent and recirculated fluid gas is combined in the secondary flame zone with the main air introduced in at least stoichiometric quantity for complete combustion to produce an effluent low in oxides of nitrogen.

The oil burner nozzle 10 of FIG. 1 is operable according to the method of the present invention. The oil burner nozzle 10 includes an oil injector 16 for producing a divergent conical oil spray, an annular gas passage 18 with a constriction 19 surrounding the oil injector 16, an annulus 20 for the admission of recirculated flue gas surrounding passage 18, and an outer annulus 22 for the admission of air surrounding annulus 20.

Annular gas passage 18 may include a tip 24 defining a flare 26 or a swirler. The flare 26 or alternatively the swirler is operable to divert gas delivered through passage 18 into a high velocity fanned pattern wider than the path of a strictly axial passage. So long as gas is injected through passage 18 at a higher velocity than the fluids injected through passages immediately adjacent thereto and the fluid patterns intersect, a toroidal fluid circulation pattern is established immediately in front of injector 16 along the combustion path. Intersection of the injected gas with the fuel spray assists atomisation. The toroidal circulation pattern promotes the establishment of a stable flame. Preferably the annular passage 18 is at a mean radius of between about 0.1 and 0.4 of the main air supply annulus 22.

With the above-described construction, the overall size of the burner is reduced compared with those using bluff body stabilisers since there is less blockage in the main air flow. Since atomization is ensured by the high velocity auxiliary air supply, it is possible to use a low pressure oil supply in the distributor or sprayer which distributor or sprayer need not itself necessarily atomize the fuel.

During combustion the amount of RFG admitted to mix with the gaseous effluent of the primary flame zone is comparable to the amount of that gaseous effluent. For example, a range of ratios of about one to about four times is suitable. Generally, however, the combined amount introduced into the primary flame zone does not exceed 20% of the total amount introduced into both the primary and secondary flame zones. The temperature of the recirculated flue gas is preferably less than about 320° C and generally not less than 120° C.

The RFG so utilized to mix with the gaseous effluent of the primary flame zone may function as an inert diluent to absorb a portion of the heat produced in the primary flame zone and to delay the admixture of oxygen and nitrogen in air until the fuel-ring gaseous effluent is cooled below the temperatures at which oxides of nitrogen can be formed.

In a specific embodiment of the method according to the invention, the high velocity gas stream creating the toroidal circulation pattern may be a stream of air of a volume substantially less than the combined volume of all fluids along the combustion path. This high velocity air in the primary flame zone establishing a stable flame is provided in sufficient quantity to supply in the range of approximately 2 to 10% of the stoichiometric oxygen requirement, and preferably from about 5 to 6% of stoichiometric.

Since a stable flame is established in the primary flame zone using an oxygen-deficient gas supply, the control of the burner can be simplified. For example, the fuel flow rate and the secondary zone air supplies can be varied over a broad range of fuel flow ratios without resultant flame instability. For example, a stable flame can be maintained to typically at least one-fifth of the predetermined full load fuel flow rate, thus providing a turn-down ratio of at least five-to-one. Variations in flow of the high velocity air stream, which is typically between 50 and 150 m/s, do not affect the flow rate of the fuel, as is the case with internal mixing "second fluid" systems making use of an atomizing fluid. The use of a low oil pressure enables large oil flow passages to be employed with reduced risk of blockage. The total auxiliary energy requirements for a burner are lower than for second fluid systems using steam.

An oil burner according to the present invention has particular application and advantages in multiple burner furnaces where one or more burners are operated discontinuously. For this purpose an oil burner nozzle is provided having means providing a high velocity gas stream, adapted for continuous operation during furnace operation. For example, nozzle 16 may be provided with a small, high velocity, continuous air stream through passage 18 which convectively cools the oil burner parts at all times during furnace operation, particularly at low fuel flow rates and during flame shut-off periods when the nozzle tip 24 is subject to damage due to the high temperatures within the furnace.

Where air is utilized the amount of excess oxygen introduced into the furnace which might interfere with combustion or contribute to inefficient operation is relatively slight since the gas is introduced in only small quantities through the constricted passage 18.

Alternatively, an oil burner nozzle may be provided wherein a continuous stream of recirculated flue gas is utilized to provide convective cooling through for example annulus 20. Since RFG is a substantially inert gas, no excess oxygen would be introduced into the furnace which might contribute to inefficient furnace operation.

In addition to the primary objects and advantages of substantially eliminating the production of oxides of nitrogen in an oil burner furnace while producing a stabilized flame without the necessity of a bluff body stabilizer, the methods and apparatus according to the present invention have still further advantages. For example, a stable flame may be established in the primary flame zone utilizing only a small amount of air. Therefore, the amount of recirculated flue gas which is required to suppress the formation of $NO_x$ gases is substantially reduced. This is of particular advantage at high fuel flow rates and where a large amount of recirculated flue gas is not available.

The high velocity air stream utilized as a primary flame zone air supply and as a coolant for the oil burner nozzle may be maintained continuously without interfering with combustion or contributing to inefficient operation in a multiple burner furnace.

A further advantage of the construction described above is that burner ancillary components such as flame detectors and ignition torches can be housed within the high velocity air supply passage 18 and can also be protected from heat.

As a still further advantage, an oil burner nozzle utilizing a continuous gas stream can be maintained substantially free from soot and the like around the tip since the continuous gas stream would substantially prevent the accumulation of foreign matter.

An oil burner nozzle according to the invention may also be provided with damper means 28 to control the ad mixture of air and recirculated flue gas admitted through an annulus 22. The recirculated flue gas is maintained in a plenum 30 at a pressure above atmospheric pressure. Therefore, air cannot be admitted through annulus 20 in the firing position as shown in the upper half of the figure. In the burner "off" position, shown in the lower half of the figure, the damper may be positioned to pass RFG through both annulus 20 and annulus 22 to ensure burner protection.

Specific embodiments of the invention have been described. Other embodiments incorporating the essential features of the invention will become obvious to those of ordinary skill in the art in light of the present disclosure. It should, therefore, be understood that all matter contained in the above description or shown in the accompanying drawings will be interpreted as illustrative and not in a limiting sense.

What is claimed is:

1. A method for producing heat in a liquid fuel burner while suppressing the production of oxides of nitrogen in a flame defining a combustion path with a primary flame zone adjacent the tip of a liquid fuel burner and a secondary flame zone substantially surrounding and extending beyond said primary flame zone along said combustion path comprising the steps of:

continuously injecting a spray of liquid fuel into said primary flame zone while directing a relatively high velocity stream of air in an intersecting manner to create a toroidal fluid circulation pattern such that the oxygen content of the high velocity air stream is approximately 5% of stoichiometric, said air stream atomizing said liquid fuel to form a fluid mixture, whereby liquid fuel is ignited and a stable flame is established in said primary flame zone to produce a gaseous effluent;

introducing recirculated flue gas into admixture with said gaseous effluent immediately after said primary flame zone to substantially increase the molar quantity of said gaseous effluent from said primary flame zone;

and thereafter combining in said secondary flame zone said gaseous mixture with air in substantially stoichiometric quantity for complete combustion.

2. A method for producing heat in a liquid fuel burner according to claim 1, wherein recirculated flue gas having a temperature between approximately 120° C. and approximately 320° C is introduced in an amount comparable to the amount of oxygen-containing gas introduced into said primary flame zone.

3. A method for producing heat according to claim 2, further including the step of introducing recirculated flue gas into said secondary flame zone to further dilute the air.

4. A method for producing heat according to claim 2, wherein the combined amount of air and recirculated flue gas introduced into the primary flame zone is less than 20% of the total molar amount introduced into both the primary flame zone and the secondary flame zone.

5. A nozzle for producing a flame suppressing the production of $NO_x$ gases in a liquid fuel burning furnace comprising:

liquid fuel injection means for introducing a continuous spray of liquid fuel into said furnace during combustion of said liquid fuel spray;

a constricted annular gas passage surrounding said liquid fuel spray injection means for providing a small continuous annular stream of high velocity air during said combustion;

flare means adjacent said liquid fuel injection means defining an inner portion of said constricted annular passage operable to direct said small annular high velocity air stream in a fanned pattern admixing with and atomizing said spray of liquid fuel for promoting the establishment of a stable fuel-rich flame;

annulus means surrounding said narrow annular gas passage operable to provide for the admission of recirculated flue gas adjacent to and combining with said admixture of liquid fuel and high velocity air;

outer annulus means surrounding said recirculated flue gas annulus means operable to provide atmospheric air in substantially stoichiometric quantity.

6. A liquid fuel burner nozzle according to claim 5 wherein said constricted annular passage is adapted to provide a small continuous stream of gas during furnace operation for cooling said nozzle.

7. A liquid fuel burner nozzle according to claim 5 wherein said recirculated flue gas annulus means is adapted to provide a continuous stream of gas during furnace operation for cooling said nozzle.

8. A liquid fuel burner nozzle according to claim 5 wherein said liquid fuel injection means is adapted to provide a continuous spray of liquid fuel over an adjustment range between a predetermined full load fuel flow rate and at least onefifth of the predetermined full load fuel flow rate and wherein said constricted annular gas passage is adapted to provide a constant high velocity air stream over said adjustment range.

9. A method for producing heat in a liquid fuel burner while suppressing the production of oxides of nitrogen in a flame, said flame defining a combustion path having a primary flame zone adjacent the tip of a liquid fuel burner and a secondary flame zone substantially enveloping said primary flame zone and extending along said combustion path, said method comprising:

injecting a divergent spray of liquid fuel into said primary flame zone while simultaneously directing a stream of oxygen-containing gas concentric about and across said divergent spray at a relatively higher velocity than that of said injected spray to atomize said liquid and to create a toroidal fluid circulation pattern, whereby liquid fuel is ignited and a stable flame is established in said primary flame zone, producing a gaseous effluent;

introducing recirculated flue gas into admixture with said gaseous effluent immediately downstream of said primary flame zone to substantially increase the molar quantity of said gaseous effluent from said primary flame zone; and thereafter combining said secondary flame zone into admixture with air in substantially stoichiometric quantity for complete combustion.

10. A method according to claim 9, wherein the total molar quantity of gas flow admitted to said primary flame zone does not exceed about 20% of the total molar quantity of gas flow of said secondary flame zone.

* * * * *